US005272884A

United States Patent [19]

Cur et al.

[11] Patent Number: 5,272,884

[45] Date of Patent: Dec. 28, 1993

[54] METHOD FOR SEQUENTIALLY OPERATING REFRIGERATION SYSTEM WITH MULTIPLE EVAPORATORS

[75] Inventors: Nihat O. Cur, Royalton Township, Berrien County; Steven J. Kuehl, Lincoln Township, Berrien County; Jatin C. Khanpara; Douglas D. LeClear, both of St. Joseph Township, Berrien County, all of Mich.

[73] Assignee: Whirlpool Corporation, Benton Harbor, Mich.

[21] Appl. No.: 961,306

[22] Filed: Oct. 15, 1992

[51] Int. Cl.[5] ..... F25B 5/00

[52] U.S. Cl. ..... 62/199; 62/152; 62/181

[58] Field of Search ..... 62/199, 200, 203, 151, 62/152, 181, 183, 184, 197, 198

[56] References Cited

U.S. PATENT DOCUMENTS

| | | | |
|---|---|---|---|
| 2,449,437 | 9/1948 | Winchester et al. | 62/200 X |
| 2,596,663 | 11/1951 | Atchison | 62/4 |
| 2,791,099 | 5/1957 | Jordan | 62/4 |
| 3,537,274 | 11/1970 | Tilney | 62/324 |
| 3,626,707 | 12/1971 | Bauknecht et al. | 62/81 |
| 4,084,388 | 4/1978 | Nelson | 62/152 |
| 4,416,119 | 11/1983 | Wilson et al. | 62/149 |
| 4,439,998 | 4/1984 | Horvay et al. | 62/199 |
| 4,474,026 | 10/1984 | Mochizuki et al. | 62/157 |
| 4,628,700 | 12/1986 | Alsenz | 62/152 |
| 4,891,952 | 1/1990 | Yoshikawa et al. | 62/199 |
| 5,031,413 | 7/1991 | Tsuihiji et al. | 62/234 |
| 5,077,982 | 1/1992 | Shaffer, Jr. | 62/199 |

*Primary Examiner*—Harry B. Tanner
*Attorney, Agent, or Firm*—Stephen D. Krefman; Thomas J. Roth; Thomas E. Turcotte

[57] ABSTRACT

A method and apparatus for sequentially operating a refrigeration system with multiple evaporators is provided in which only one evaporator is operated at a time and is run until a detected demand for cooling associated with that evaporator is satisfied, or until a predetermined time period has elapsed which corresponds to the normal run time for that evaporator. If the run time expires prior to the demand for cooling being satisfied, and if demand for cooling by another one of the evaporators is present, then operation of the first evaporator is terminated and the other evaporator is operated. Efficiency enhancements are provided such as prematurely initiating operation of a second evaporator at the conclusion of operation of a first evaporator if it appears that a demand for cooling by the second evaporator will occur within a short period of time following termination of operation of the first evaporator.

19 Claims, 11 Drawing Sheets

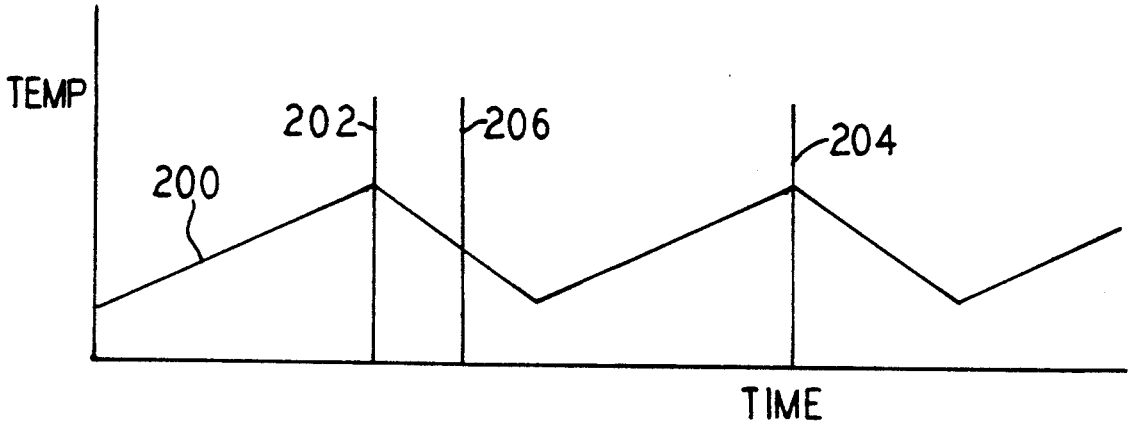
FIG. 13
FIG. 14
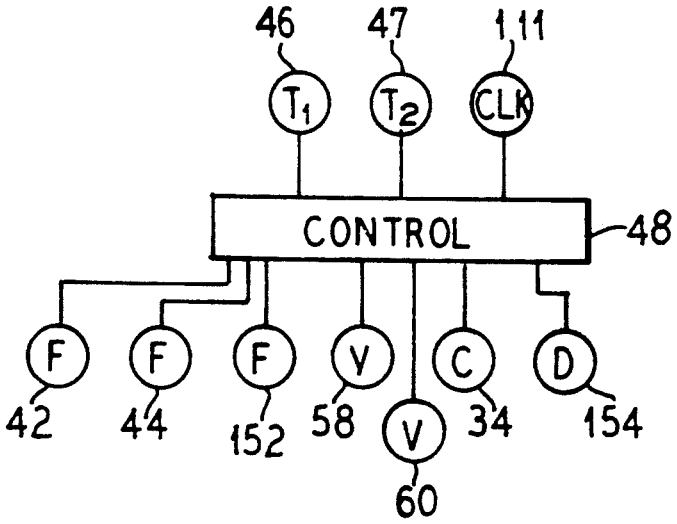

METHOD FOR SEQUENTIALLY OPERATING REFRIGERATION SYSTEM WITH MULTIPLE EVAPORATORS

BACKGROUND OF THE INVENTION

The present invention relates to refrigeration appliances and more particularly to a method for operating refrigeration appliances having multiple evaporators.

In typical domestic refrigeration appliances, the appliance oftentimes has two separate compartments which are maintained at different temperatures. For example, there may be a freezer compartment which has a temperature maintained below 0° C. and a fresh food compartment which is maintained at a temperature somewhat above 0° C.

In many commercially available refrigeration devices a single evaporator is used with an evaporating pressure of approximately 0–2 psig. Air is circulated over the evaporator from both the freezer compartment and the refrigerator compartment. This "mixed" air flow scheme results in dehumidification of the refrigerator compartment and subsequent frost build-up on the single evaporator coil, necessitating a periodic defrost cycle to get rid of the accumulated frost.

Also, using a single evaporator to provide the cooling for two compartments which are maintained at different temperatures results in an inefficient use of the refrigeration system for the higher temperature compartment.

It is known in the art to utilize multiple evaporators in refrigeration appliances. U.S. Pat. No. 2,576,663 discloses the use of two evaporators, each for its own refrigeration compartment. The evaporators are alternately supplied with refrigerant through a control valve.

U.S. Pat. No. 3,390,540 discloses the use of multiple evaporators in a refrigeration system. Each evaporator is controlled by an expansion valve and it is possible to operate more than one evaporator at a time.

U.S. Pat. No. 3,108,453 discloses a multiple evaporator refrigeration system in which the evaporators may be used independently of each other. Also a phase change material is used in connection with at least one of the evaporators.

U.S. Pat. No. 3,786,648 discloses the use of multiple evaporators for controlling the temperature in multiple compartments with the evaporators operating independently of each other.

U.S. Pat. No. 4,439,998 discloses a refrigeration apparatus having multiple evaporators with an electronically controlled valve system to deliver refrigerant to one evaporator in preference to the other, but causing the valve system to deliver refrigerant to the other evaporator after a predetermined amount of time.

U.S. Pat. No. 4,916,916 discloses the use of a phase change energy storage material in connection with a multiple evaporator refrigeration system.

SUMMARY OF THE INVENTION

The present invention provides a method for operating a refrigeration appliance with multiple evaporators in which the evaporator circuits operate sequentially. In the preferred embodiments disclosed there are two evaporator circuits, one operating a freezer compartment and the other operating a fresh food compartment. The freezer compartment runs typically at 0–2 psig evaporating pressure until satisfied. The refrigerator section then runs typically at 18–22 psig evaporation pressure, at which pressure level, significant energy reductions are achieved.

A single compressor supplies the refrigerant through the condenser which serves to feed either the high or low pressure evaporators through known expansion devices such as capillary tubes, orifices, expansion valves, etc. Although various circuit options are disclosed, each employ some type of solenoid valve at the capillary tube inlet to determine which evaporator is fed.

In some devices in which the invention is used, a phase change material may be utilized with one or more of the evaporators in order to utilize a more efficient compressor and to reduce the overall energy consumption by the refrigeration appliance.

A control is supplied for carrying out the method steps and for determining which evaporator is to be operated at any given time. The refrigerator evaporator is given preference, that is, if the fresh food compartment demands cooling first, or if both the fresh food and the freezer compartment demand cooling simultaneously, then the fresh food evaporator circuit is first operated until either the temperature sensor lower set limit in the fresh food compartment is satisfied or until a certain maximum length of time corresponding to a typical run cycle under normal operating conditions for the fresh food compartment evaporator has occurred. If the fresh food compartment temperature sensor lower set point has been satisfied, the freezer compartment temperature sensor is checked and if it is found to be above the upper set limit (demanding cooling) then the freezer compartment evaporator is turned on in lieu of the fresh food evaporator. However, if the fresh food compartment temperature sensor has been satisfied and the freezer compartment is not demanding cooling; then the compressor is turned off and the refrigeration appliance waits for further demand signals.

If the typical run time for the fresh food evaporator has run out before the fresh food temperature sensor lower set limit (cut-off temperature) has been satisfied and the freezer compartment is requiring cooling, the fresh food evaporator is turned off and the freezer evaporator is turned on. The freezer evaporator then runs either until it is satisfied or until it has run for a predetermined amount of time corresponding to a typical freezer evaporator run time under normal operating conditions, whichever is first. Upon achieving either of those conditions, the freezer evaporator is pumped of refrigerant and is turned off and then the fresh food evaporator is turned on and the cycle repeats until both compartments are satisfied.

Once both the fresh food compartment and the freezer compartment temperature sensors are satisfied, the compressor is turned off and the refrigeration appliance waits for further demand signals. If the freezer temperature sensor is first to demand cooling (above the upper set limit), then the freezer evaporator circuit is turned on and it runs either until satisfied or until the fresh food compartment temperature sensor goes above its upper set limit (demanding cooling), whichever occurs first. If the freezer compartment is satisfied first and the fresh food compartment does not require cooling, then the compressor is turned off and the refrigeration appliance waits for further demand signals. If the fresh food compartment temperature sensor demands cooling, the freezer evaporator continues to run until it has run for the predetermined time that a freezer evaporator typically runs under normal operating conditions. Upon the conclusion of that time, the freezer evaporator is turned off and is pumped of refrigerant and then the fresh food evaporator circuit is turned on. The fresh food evaporator runs either until satisfied or, if the freezer continues to demand for cooling, until the predetermined length of time has passed in which the fresh food evaporator typically runs. At no time are both the fresh food and freezer evaporators run simultaneously.

An enhancement of this cycle is that before the compressor is turned off at the end of either a fresh food evaporator cycle or a freezer evaporator cycle, not only is it first checked to determine whether the other compartment temperature sensor is above its upper set limit (demanding cooling), it is also checked to determine whether the temperature in the other compartment is sufficiently close to the temperature at which cooling will be demanded, meaning that a relatively short "off" period would ensue before cooling is demanded. If a short time period or small temperature differential is detected, then the other evaporator is activated, prematurely, in order to enhance overall system efficiency since inefficiencies occur at the initial start up of the compressor.

Other efficiency enhancements are provided, such as initiating a defrost cycle for the freezer evaporator only at the point in time after a preset time period at which the freezer compartment demands cooling. Thus, the defrost cycle will begin when the freezer compartment, and thus evaporator, are at the warmest allowed temperature, thus reducing the amount of energy which must be input to the freezer evaporator to effect the defrosting. Also, the provision of latching valves minimize the electrical energy input and assist in preventing refrigerant migration to evaporators during an "off" portion of the cycle.

BRIEF DESCRIPTION OF THE DRAWINGS

FIG. 13 is a schematic graphical illustration of time versus temperature within the freezer compartment and how it relates to the defrost initiation cycle.

FIG. 14 is a schematic diagram of a control with its various inputs and outputs.

DETAILED DESCRIPTION OF THE PREFERRED EMBODIMENTS

Figure 1:
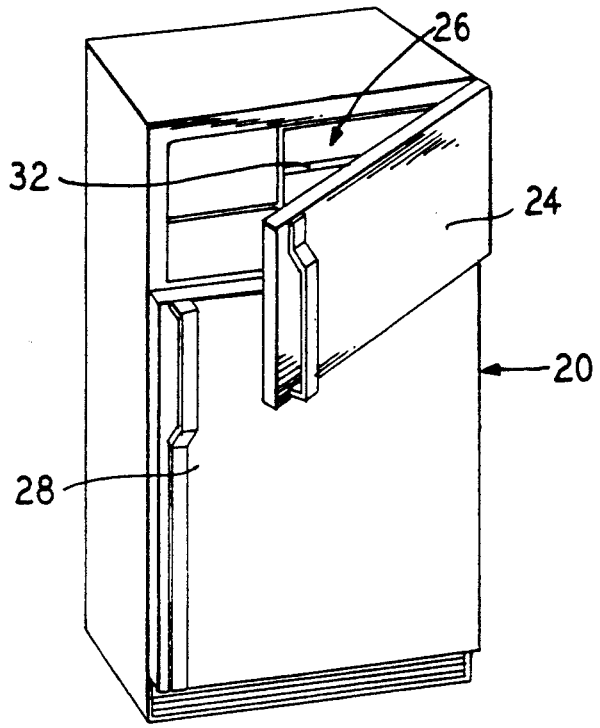
FIG. 1 is a perspective view of a refrigeration appliance in which the method embodying the principles of the present invention may be used.
Figure 2:
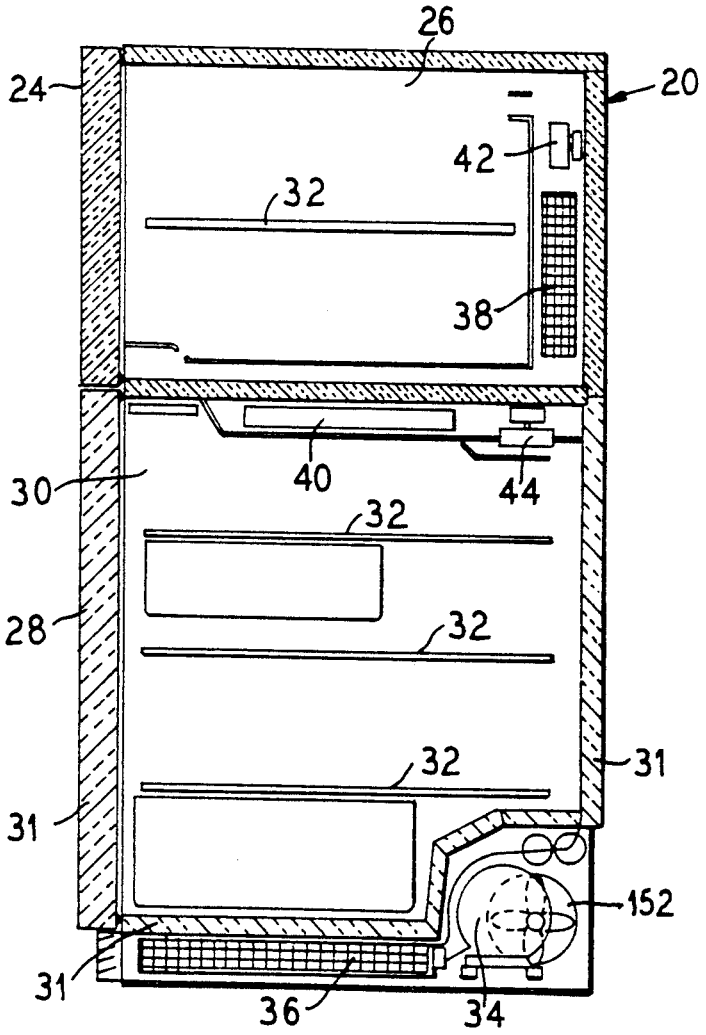
FIG. 2 is a side sectional view of the appliance of FIG. 1.

In FIGS. 1 and 2 there is shown generally a refrigeration appliance at 20 which comprises an exterior cabinet 22 having a first openable door 24 to expose a first interior compartment 26 and a second openable door 28 to expose a second interior compartment 30. Within each of the compartments 26, 30 there may be one or more shelves 32 for receiving food articles. Generally one of the compartments 26, 30 will be maintained at a temperature sufficiently below 0° C. to assure that all of the articles contained within that compartment will be maintained in a frozen state. The other compartment generally is maintained somewhat above 0° C. to maintain the items placed therein in a chilled, but not frozen condition.

In order to maintain the compartments at the desired temperature levels a refrigeration device is provided which comprises a compressor 34, a condenser 36, an evaporator 38 for the first compartment 26 and a second evaporator 40 for the second compartment 30. Appropriate air moving devices 42, 44 are provided for circulating air within each of the compartments past its respective evaporator to maintain a fairly consistent temperature throughout each compartment.

A temperature sensor 46, 47 is provided for each compartment 26, 30 to provide appropriate signal inputs to a control 48 (FIG. 14) for the appliance.

Although in carrying out the steps of the inventive method various types of refrigeration circuits can be utilized which have a plurality of evaporators, each operated sequentially and not concurrently, a number of specific exemplary refrigeration circuits are illustrated in detail in FIGS. 3 and 6 through 11.

Figure 3:
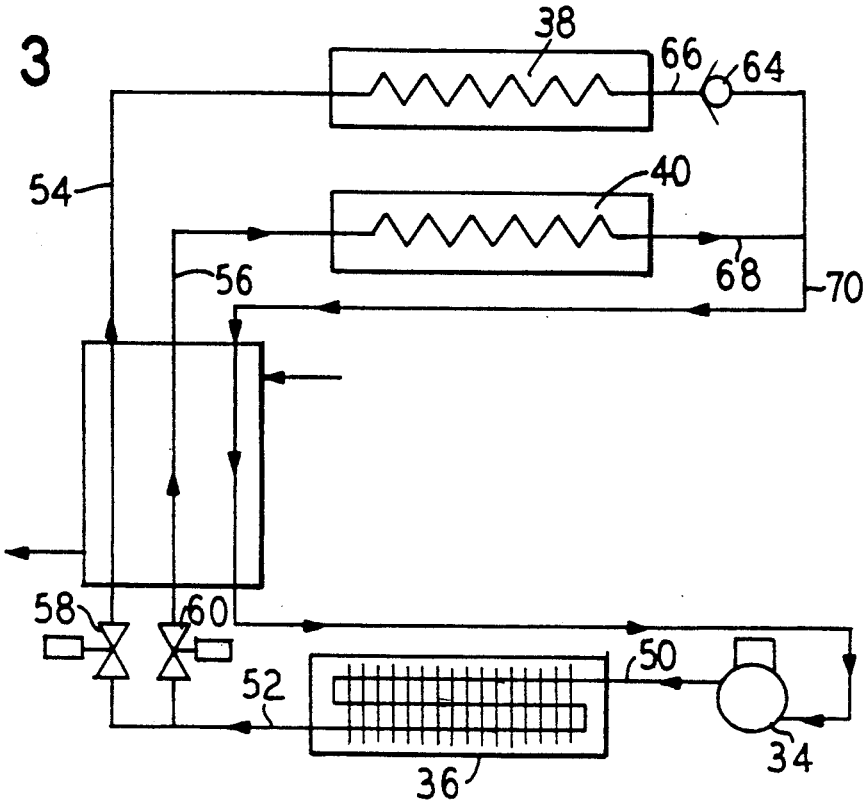
FIG. 3 is a first embodiment of a refrigeration circuit diagram.
Figure 6:
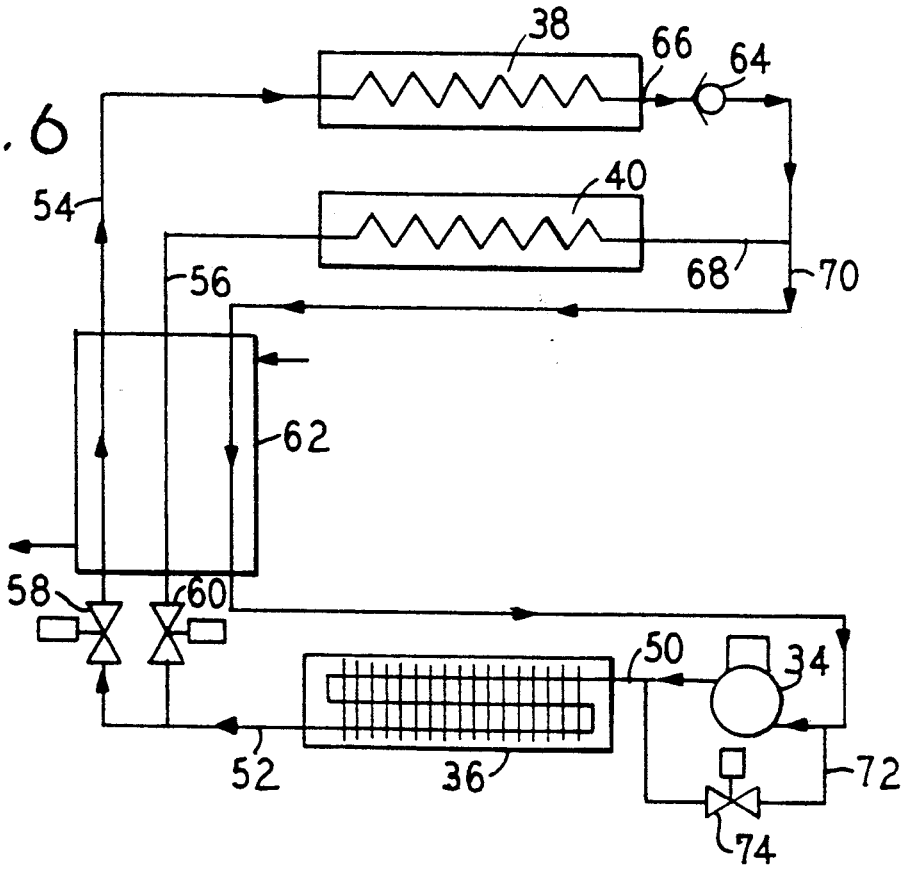
FIG. 6 is a second embodiment of a refrigeration circuit diagram.

In FIG. 3 a first embodiment of a refrigeration circuit is illustrated. In this embodiment the single compressor 34 supplies refrigerant through line 50 to the single condenser 36. Refrigerant then flows out of condenser on line 52 and is presented to parallel lines 54, 56 each of which are supplied with an individual latching type solenoid valve 58, 60. The solenoid valves 58 and 60 should preferably be the latching type which requires power for a brief moment (a fraction of a second) to change position from open to closed or vice versa. If the latching type valves are not used, then the valve 58 should be a normally closed type and the valve 60 should also preferably be a normally closed type but the normally open type can be used too. Lines 54 and 56 pass through a heat exchanger 62 towards evaporators 38 and 40 respectively. A check valve 64 is provided on suction line 66 which exits from evaporator 38. Suction line 68 which exits from evaporator 40 has no such valve. Lines 66 and 68 join in a return suction line 70 which also passes through the heat exchanger 62 on its return to the compressor 34.

Figure 4:
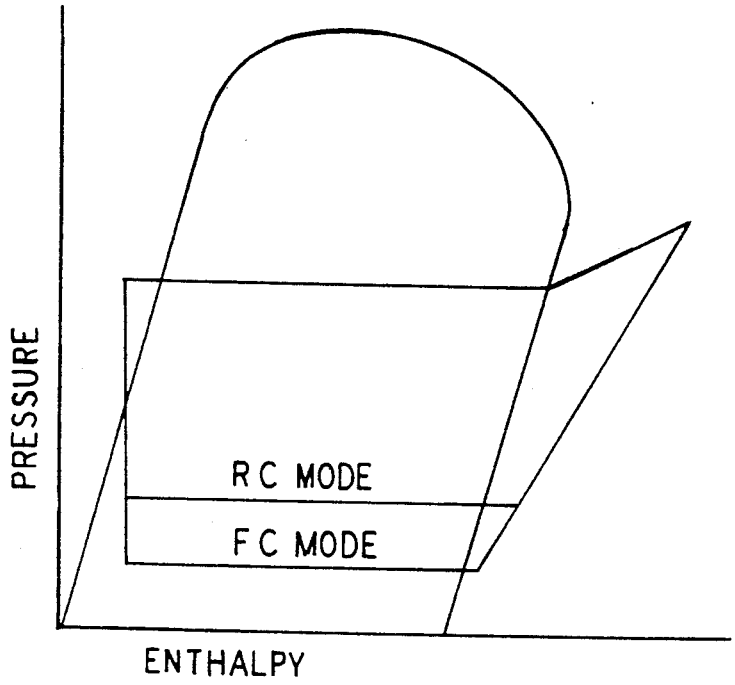
FIG. 4 is the representation of the refrigeration cycle on a pressure-enthalpy diagram.

FIG. 4 is the representation of the sequentially-operated two evaporator refrigeration system on a pressure-enthalpy diagram. As shown in FIG. 4, FC mode indicates the freezer mode of operation and the evaporation occurs at a lower suction pressure similar to the conventional refrigeration system. RC mode indicates the fresh food compartment cooling and the evaporation occurs at a higher suction pressure.

Figure 5:
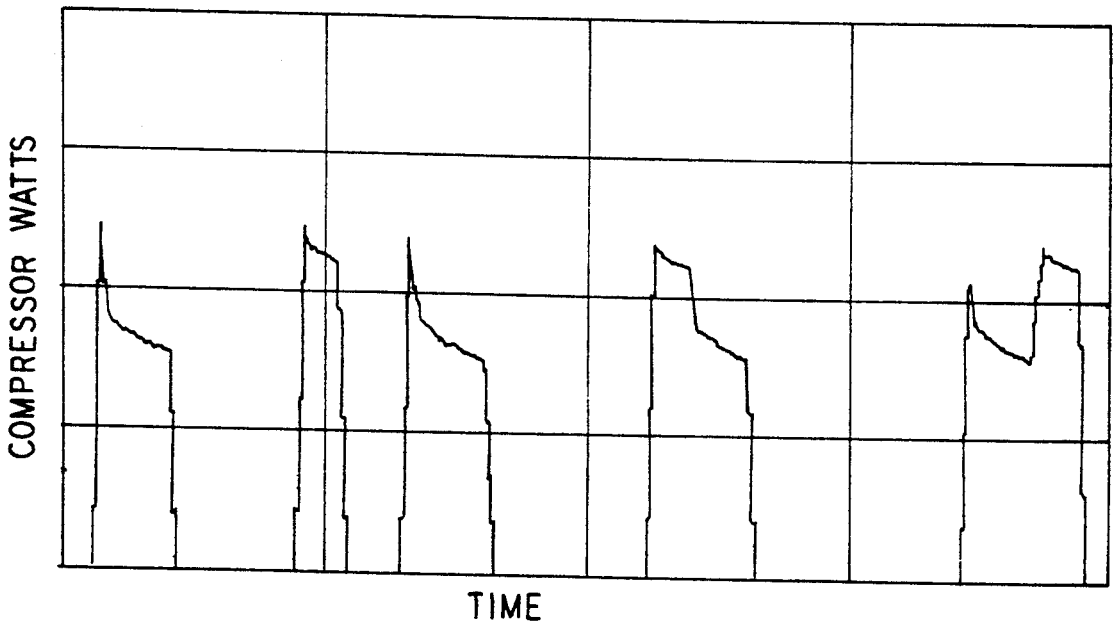
FIG. 5 is a typical representation of the compressor power usage against time with a sequentially-operated dual evaporator refrigerator.
Figure 7:
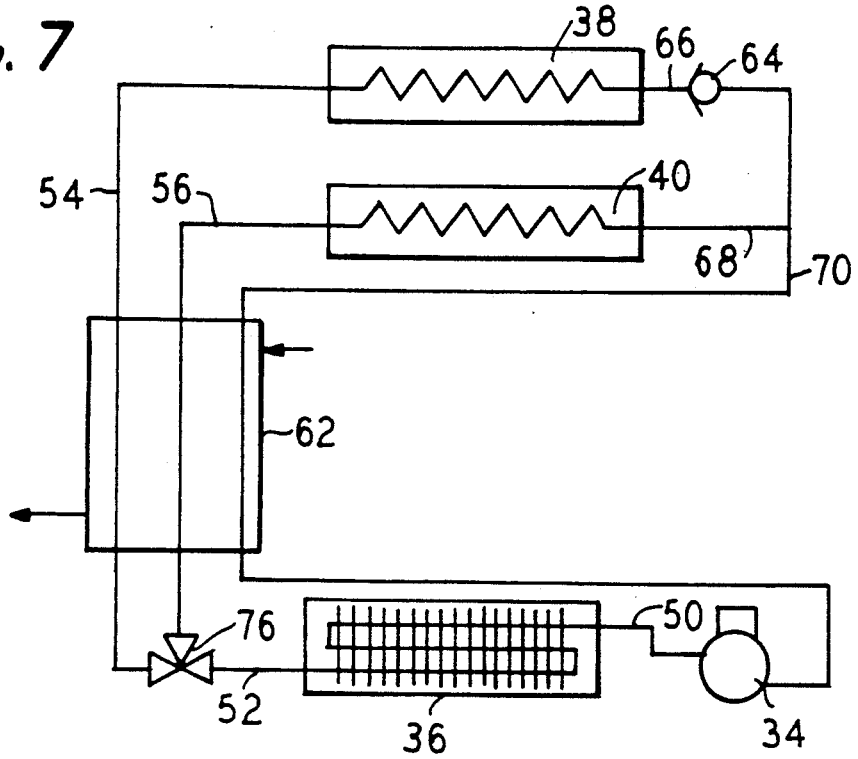
FIG. 7 is a third embodiment of a refrigeration circuit diagram.

FIG. 5 is the typical compressor power data (y-axis) vs time (x-axis) graph. As shown in FIG. 5, the fresh food cooling mode has the higher compressor power peaks and the freezer compressor operation has the lower compressor power peaks and there is no power consumption (off-cycle) in between the on-cycle modes of operation. As is apparent from the actual power data, at times the fresh food cooling mode and the freezer cooling mode follow each other in a sequential manner with no off-cycle in between and at other times they are separated with an off-cycle in between.

A second embodiment (FIG. 6) of the refrigeration cycle contains many of the same components which are identified with the same reference numerals as used in FIG. 3. The primary difference between the embodiment of FIG. 6 and that of FIG. 3 is that a bypass line 72 is provided around the compressor 34 which allows pressure equalization across the compressor through a solenoid valve 74 prior to its start-up.

Again, a third embodiment (FIG. 7) of the refrigeration cycle contains many of the same components which are identified with the same reference numerals as used in FIG. 3. The primary difference between the embodiment of FIG. 7 and that of FIG. 3 is that a three-position latching valve 76 is utilized at the junction of lines 52 and 56 which allows refrigerant to flow either through line 56 or line 54, but not both. The third position of the valve 76 is to close both lines 56 and 54.

Applicants have determined that it presently appears that the embodiment illustrated in FIG. 3 has the highest potential for energy reduction during operation. Therefore, the various modes of operation of the two evaporators will be described with respect to that embodiment.

In this embodiment evaporator 38 is utilized in the refrigerator compartment 26 which is maintained at a below freezing temperature and thus the evaporator is operated at a lower pressure, generally in the range of 0–2 psig.

Evaporator 40 is utilized in the fresh food compartment and is normally maintained above freezing temperature and is operated at a higher pressure, generally in the range of 18–22 psig. With sufficient thermal insulation provided around the freezer compartment 26, the percentage run time in the freezer mode, that is, the mode in which refrigerant is supplied to evaporator 38, can be reduced significantly, such as to approximately 20–25% of the overall run time. The remaining run time is utilized in operating evaporator 40 for the fresh food compartment.

Since the evaporator 40 operates at a higher suction pressure, where the compressor 34 has a much higher cooling capacity, a lower capacity down-sized compressor could be used in such a system. Some slight to moderate downsizing of the compressor is possible and utilized with the invention. The compressor may be downsized 0 to 40% in cooling capacity with respect to a state of the art single evaporator, single compressor system embodied in a similar refrigerator cabinet. However, current compressor technology results in a degradation of efficiency of the compressor in smaller, lower capacity sizes when the compressor is downsized too far. This degradation is due to the mechanical and manufacturing limitations of smaller compressor mechanisms.

Therefore, Applicants have found that the compressor 34 similar in capacity to that of a comparable conventional single evaporator vapor compression system or somewhat down-sized in capacity (but still too large for the sequentially-operated dual evaporator system) can be used in disclosed embodiments with the excess cooling capacity being stored as thermal energy in a thermal storage or phase change material associated with evaporator 40 (and evaporator 38 if desired) such that the material will change phase either from a gas to a liquid or from a liquid to a solid during operation of evaporator 40. An example of this type of material could be a mixture of water (80 to 100%) and an organic material, such as propylene glycol (20 to 0%). This permits the compressor to be run less frequently, and excess compressor cooling capacity to be absorbed thus allowing it to run at higher suction pressures as desired, and relying on the phase change material to absorb heat energy during periods when the refrigerant is not being supplied through evaporator 40. Of course, the excess cooling capacity can also be handled by making the evaporator 40 larger with adequate fresh food compartment evaporator airflow, but the evaporator 40 would occupy more space thus taking more volume from the refrigerated space.

In order to provide a switch in between two distinct refrigeration circuits for sequential operation and to maintain proper charge distribution in the circuit, the current invention utilizes refrigerant valves 58 and 60 and a check valve 64. The refrigeration valves 58 and 60 can be of the kind which are operated by a solenoid but are not limited to that. In fact, the preferred embodiment illustrated in FIG. 3 utilizes two latching type solenoid valves for valves 58 and 60. The regular solenoid valves require electrical power (5 to 15 watts range) to their coils to remain open or closed (depends on whether they are normally closed or open type), therefore necessitating power consumption at least for a certain portion of their operation. Also, some of the power used by the valve coil gets transferred to the refrigerant in the form of heat. Both of these affect the overall refrigeration system energy efficiency to a small degree and reduce the energy savings expected from a sequentially-operated dual evaporator system. The latching solenoid valves (valves 58 and 60 in FIG. 3), on the other hand, require only a pulse (very brief, in terms of milliseconds) of electrical input to change position but requiring no other power input to remain open or closed.

The check valve 64 is unique to this invention and is vital for the proper refrigerant charge distribution during the sequential operation. Without it, the higher pressure refrigerant from evaporator 40 during the fresh food cooling mode would go to the lower pressure area in the colder freezer evaporator 38 and accumulate there. Since the refrigerant charge is determined based on only a single circuit, the refrigerant accumulation in evaporator 38 would cause the system to have less than the optimum refrigerant charge, thus starving the evaporator 40 during the fresh food cooling mode. The check valve 64 with the higher suction pressure on line 70 closes during the fresh food cooling mode, therefore preventing the refrigerant from accumulating in the evaporator 38. During the freezer cooling mode, the suction pressure on line 70 goes down and the check valve 64 opens up, thus allowing flow through the evaporator 38. Since the suction pressure on line 70 is lower than the pressure in the evaporator 40 during the freezer cooling mode, there is no need for such a check valve on the fresh food evaporator 40 outlet.

With respect to the modes of operation of the refrigeration circuit of FIG. 3, FIGS. 8–11 illustrate the various operation modes.

Figure 8:
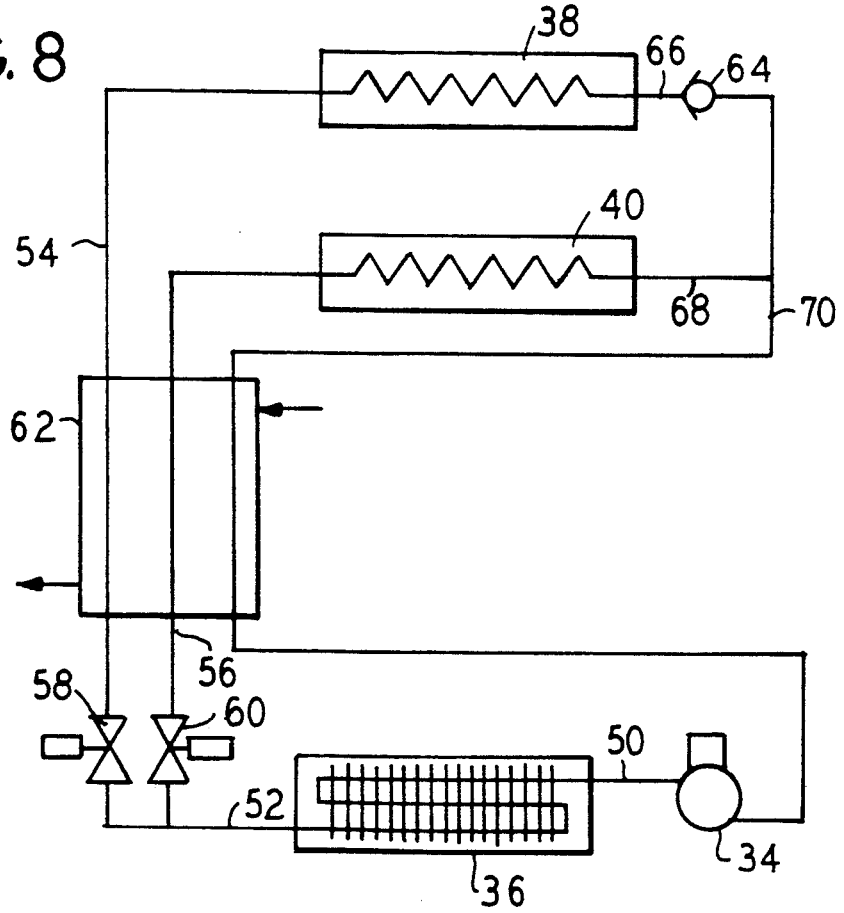
FIG. 8 is the first embodiment of the refrigeration circuit diagram shown in an off-cycle mode.

In FIG. 8 the off-cycle mode is illustrated. In that mode of operation, latching solenoid valve 60, joining lines 56 and 52, and latching solenoid valve 58, joining lines 54 and 52, are both closed for the major portion of the off-cycle. Check valve 64 on line 66 is also closed during the off-cycle mode and there is basically no refrigerant (some refrigerant vapor might be present) in lines 54, 56, 66 and 68 or in evaporators 38 and 40. The refrigerant therefore is present throughout a circuit which includes the compressor 34, line 50, condenser 36 and line 52. At the end of an off-cycle (when either compartment calls for cooling), the latching solenoid valve 60 is energized briefly to open, thus permitting refrigerant migration and pressure equalization through the fresh food circuit while the compressor 34 is still in an off condition (typically a 3 minute equalization time is required).

Figure 9:
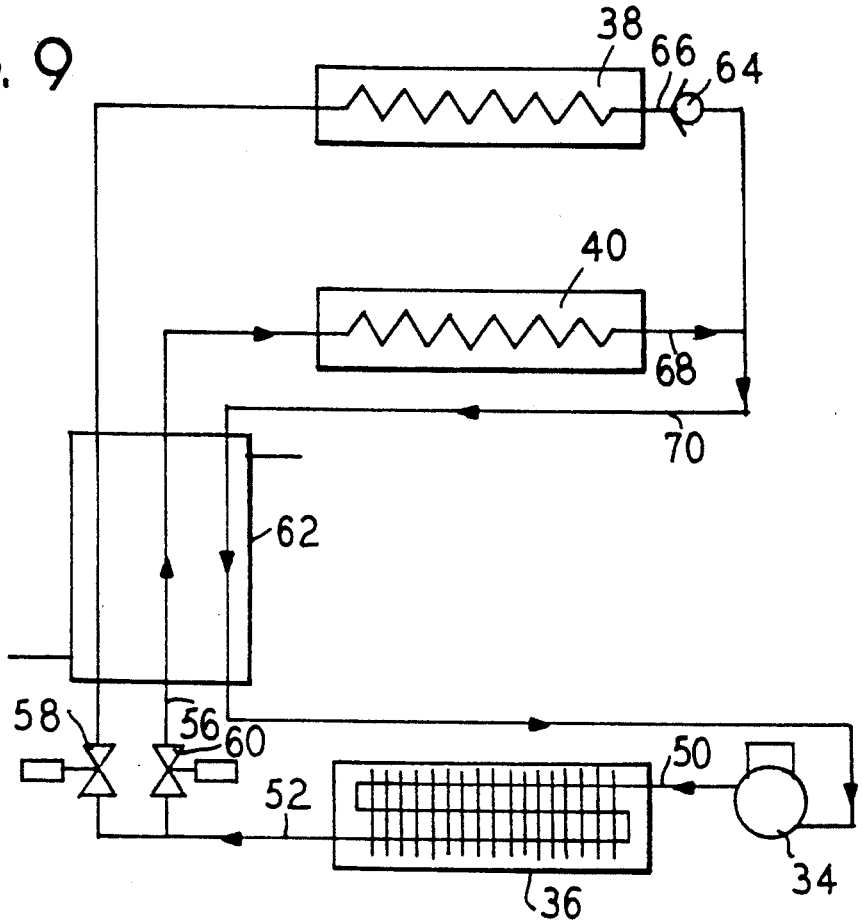
FIG. 9 is the first embodiment of the refrigeration circuit diagram as shown in a fresh food cooling mode.

FIG. 9 illustrates operation of the system in a fresh food cooling mode. The pressure equalization (not needed if this cycle comes just after the freezer mode of operation) and the subsequent fresh food cooling mode are initiated and the fresh food cooling mode is terminated in response to an appropriate control signal representing a temperature condition of the fresh food compartment 30, time dependent signal or other control. In this mode, the latching solenoid valve 60 is now open (just after the pressure equalization) and remains non-energized and thus in the same condition as described at the end of an off-cycle. If this mode follows the freezer cooling mode, then the latching solenoid valve 58 is briefly energized to close and the latching solenoid valve 60 is briefly energized to open. Also, check valve 64 is normally closed and the latching solenoid valve 58 is closed (same as in the off-cycle mode shown in FIG. 8).

The major difference in FIG. 9 is that the compressor 34 is on and thus refrigerant is being pumped through the circuit in the direction of the arrows. Thus, refrigerant flowing from the condenser 36 flows through lines 52 and 56 through the heat exchanger 62 and into evaporator 40 where heat is absorbed from the air circulating over the evaporator 40 in refrigerator compartment 30 as well as absorbed from the phase change material (if used) associated with evaporator 40. The refrigerant then flows through suction lines 68 and 70, back through the heat exchanger 62 to return to the compressor 34.

Figure 10:
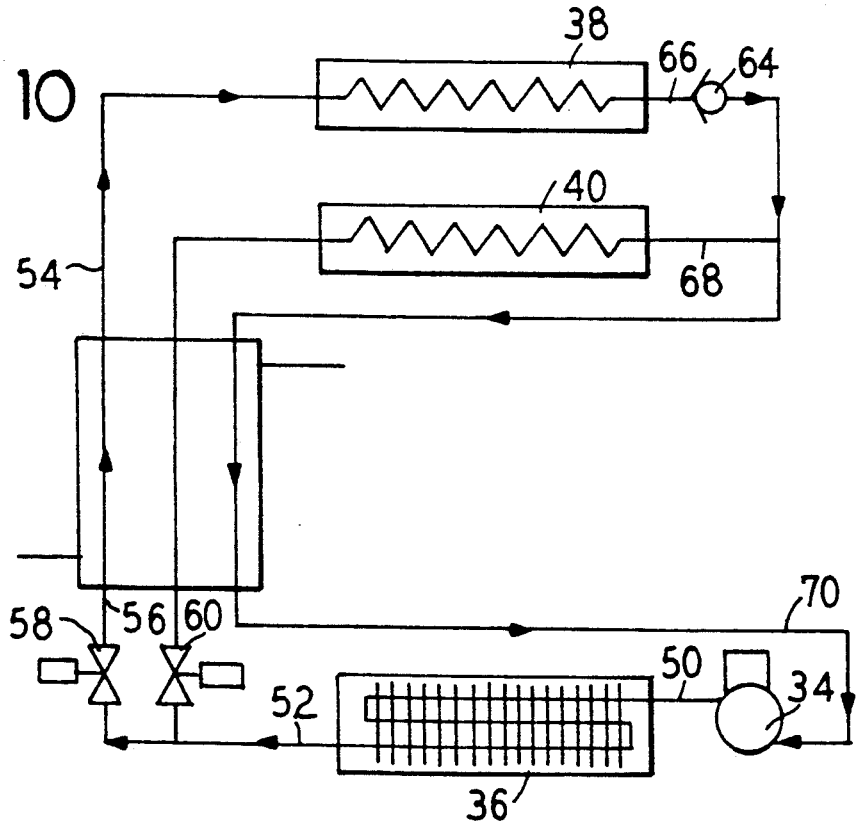
FIG. 10 is the first embodiment of the refrigeration circuit diagram shown in a freezer cooling mode.

FIG. 10 illustrates the operation of the circuit with the evaporator 38 in operation, that is, the freezer cooling mode. This mode is also initiated and terminated in response to an appropriate control signal representing a temperature condition of the freezer compartment 26, a time dependent signal or other control signal. If freezer cooling mode is initiated after an off-cycle, the latching solenoid valve 60 is open during the pressure equalization period to allow pressure equalization over the fresh food compartment cooling circuit. Once the pressure equalization is complete or if the freezer cooling mode starts after a fresh food cooling cycle, the latching solenoid valve 60 is briefly energized to close and the latching solenoid valve 58 is briefly energized to open (to start the freezer cooling) so that line 52 is opened to line 54 and closed to line 56. Check valve 64 will be open due to a flow of refrigerant into it from evaporator 38.

In this mode of operation, the compressor is required to provide a much lower pressure on suction line 70. In this mode refrigerant is supplied from the compressor 34 through line 50, condenser 36, line 52, and line 54 to the evaporator 38 and then out line 66 through valve 64 to line 70 to return to the compressor. Any refrigerant remaining in line 56 and evaporator 40 will be at a higher pressure and thus there will not be any migration of refrigerant from line 66 into line 68 and evaporator 40. With valve 60 closing the connection between line 52 and line 56, line 68 will represents a high pressure dead end line, thus blocking any flow of refrigerant into line 68 from line 66.

Figure 11:
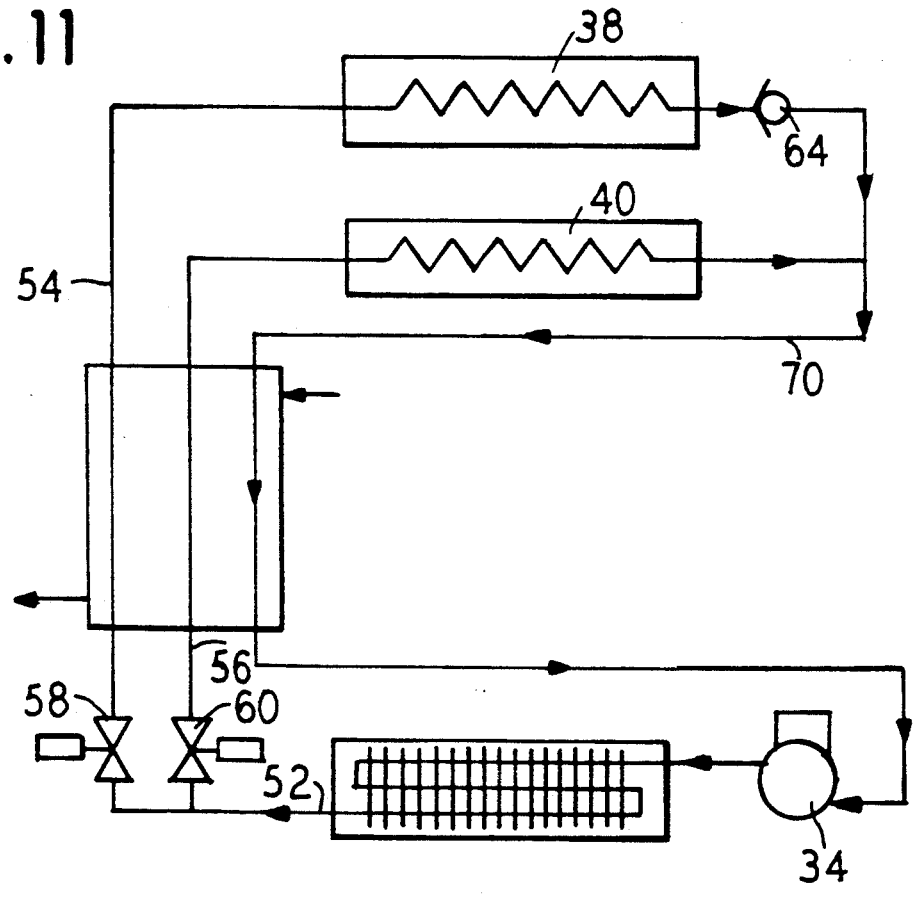
FIG. 11 is the first embodiment of the refrigeration circuit diagram shown in a freezer evaporator pump-out mode.

FIG. 11 discloses a pump-out mode during which time refrigerant is pumped out of the evaporator 38 at the end of the freezer cooling mode. In this mode of operation the latching solenoid valve 60 remains closed thus keeping a closed path between line 52 and line 56 leading to high pressure evaporator 40. The latching solenoid valve 58, however, is also briefly energized or electrically pulsed and thus moved to a closed position thus preventing flow of refrigerant from line 52 to line 54. Check valve 64 is opened due to the low pressure in line 70.

In this mode of operation the compressor 34 runs to provide the low pressure suction on line 70. This low pressure suction causes refrigerant to be evacuated both from evaporator 38 and evaporator 40. This step is undertaken to assure that sufficient refrigerant will be available for efficient operation of evaporator 40 in the mode shown in FIG. 9. Since the refrigeration circuit only has sufficient refrigerant for the evaporator 38 circuit or the evaporator 40 circuit alone, the refrigerant charge distribution is critical and it is absolutely necessary that the refrigerant does not get trapped in evaporator 38 during the fresh food mode operation, thus requiring the pump-out mode illustrated in FIG. 11 at the end of the freezer cooling mode illustrated in FIG. 10.

Following completion of the pump out mode of FIG. 11, which can occur for a predetermined time period or in response to a sensed condition, the compressor 34 is first turned off, the valves 58 and 60 remain closed if an off-cycle mode of operation is to follow. With the compressor 34 turned off and the valves 58 and 60 closed, check valve 64 will close due to low pressure in evaporator 38 and relatively higher pressure in line 70, thus resulting in the condition shown in FIG. 8 as the off-cycle mode. At the end of the off-cycle mode, refrigerant will be allowed to migrate through line 56 and evaporator 40 to equalize pressure across the compressor thereby permitting an easier start condition for the compressor. If a fresh food mode operation is to follow the pump-out mode, then the compressor 34 will remain on, the valve 58 will close and the valve 60 will open at the end of the pump-out mode.

Figure 12:
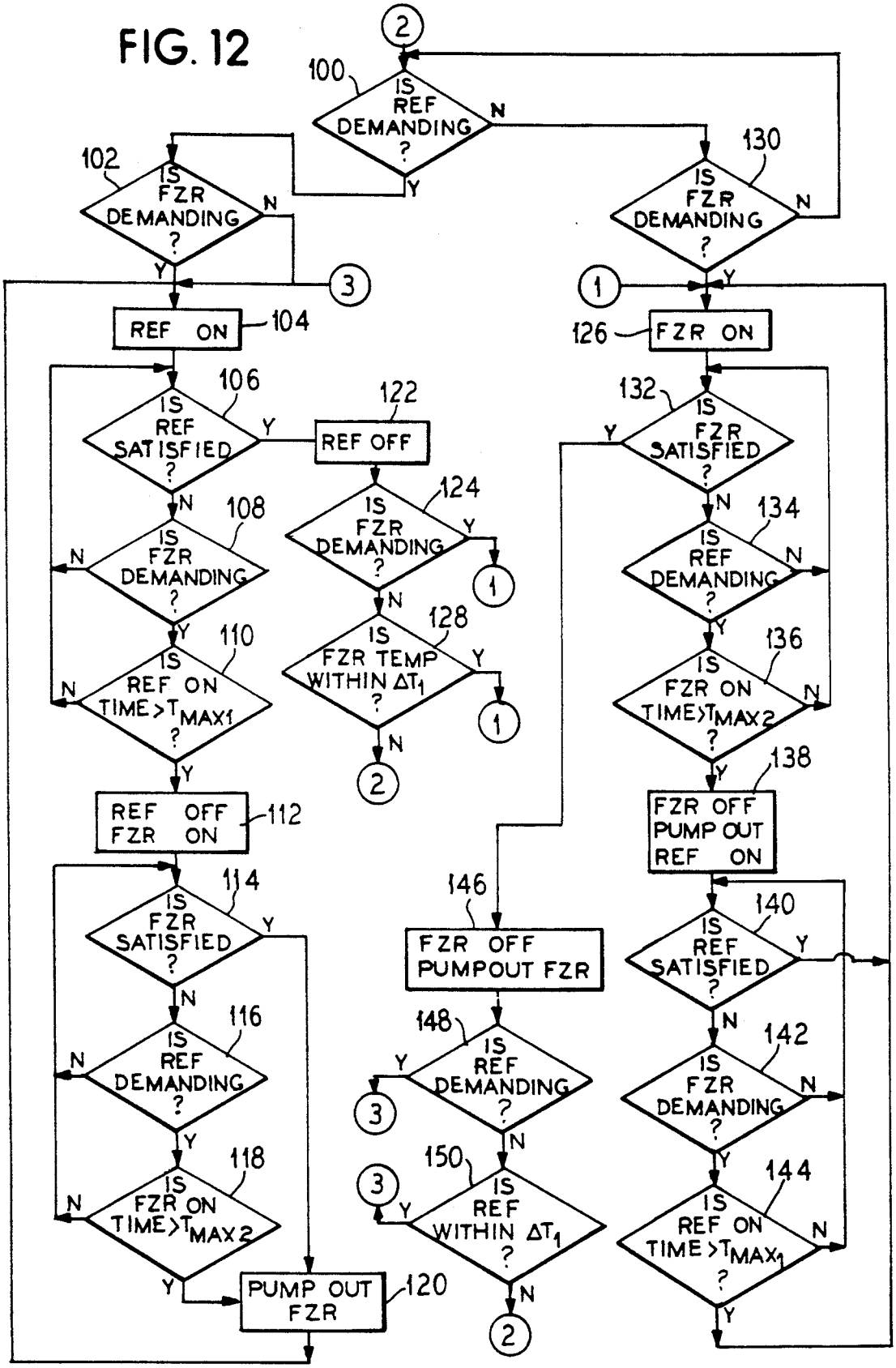
FIG. 12 is a flow chart diagram illustrating the control sequences for the multiple evaporators.

With any of the above embodiments the control 48 is designed to provide a particular series of steps for operating the two evaporators sequentially to assure the necessary cooling requirements. In FIG. 12 there is illustrated a sample flow chart illustrating a method of control embodying the principles of the present invention.

Figure 12A:
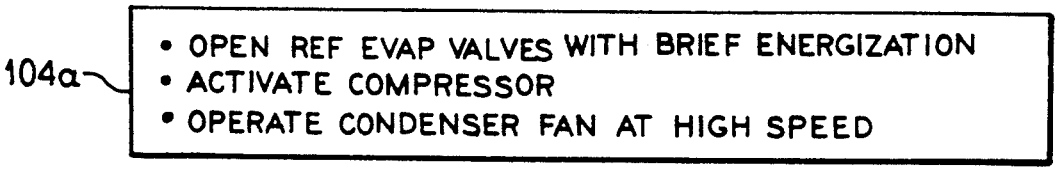
FIG. 12*a* illustrates an expansion of step 104 of FIG. 12.

In step 100 there is a determination of whether the fresh food compartment 30 is demanding cooling. Generally this occurs when the compartment reaches a temperature which has been set by the temperature sensor 46 as an upper limit temperature. If the fresh food compartment is demanding cooling, control passes to the left side of the flow chart since the fresh food compartment has priority. Step 102 illustrates an inquiry as to whether the freezer compartment 26 is demanding cooling, although as shown, whether or not the freezer compartment is demanding cooling, control is passed to step 104 in which the fresh food compartment evaporator 40 is activated by the control activating the appropriate valves and compressor 34 (see FIG. 12*a*). Inquiry is then made in step 106 as to whether the fresh food compartment temperature sensor 46 lower set limit is satisfied (signaling end of cooling demand for that compartment).

If the temperature sensor lower set limit is not yet reached, control passes to step 108 to determine whether the freezer temperature sensor 47 is demanding cooling. If the freezer temperature sensor is not demanding cooling (below the upper set limit) then control is passed back to step 106 to repeat steps 106 and 108 as set forth above.

If, in step 108 it is determined that the freezer temperature sensor 47 is demanding cooling (above the upper set limit), then control passes to step 110 where an inquiry is made to determine how long the fresh food compartment evaporator 40 has been running based on input from clock 111. A time period, designated as $T_{max1}$ is preset to represent the length of time that a fresh food compartment evaporator typically runs during a normal cooling cycle without unusual events such as extended door openings, large quantity of warm food placement in the fresh food compartment, etc. If the time that the fresh food compartment evaporator has run during this cycle is less than $T_{max1}$, then control is passed back to step 106 for a repetition of the above steps.

However, if the evaporator run time exceeds $T_{max1}$ prior to the fresh food compartment temperature sensor being satisfied, then control passes to control unit 112 wherein the appropriate valves are operated such that the fresh food compartment evaporator 40 is turned off and the freezer evaporator 38 is turned on to begin a cooling of the freezer compartment 26 (since the conditions in the freezer require this). This will occur even though the fresh food compartment 30 has not yet reached a temperature level to satisfy the fresh food compartment temperature sensor (lower limit temperature).

Control then passes to step 114 where it is inquired whether the freezer temperature sensor 47 is satisfied. If it is not yet below the lower set limit temperature, control passes to step 116 to determine whether the fresh food compartment temperature sensor 46 is demanding cooling. Since it is quite likely that the fresh food compartment temperature sensor will be demanding cooling in this scenario, control is passed to step 118 where an inquiry is made to determine whether the freezer evaporator has been on for a preset time period. In this case, a second time period designated as $T_{max2}$ is set which a typical length of time that the freezer evaporator 38 runs in a normal cooling cycle without unusual events such as extended freezer compartment door openings, large quantity of unfrozen food placement in the freezer compartment, excessive ice cube usage, etc. Control will continue to cycle through this loop until either the freezer temperature sensor is satisfied or the time period $T_{max\ 2}$ has occurred. Upon the first of either of those events, control passes to step 120 wherein the refrigerant is pumped out of the freezer evaporator 38, as described above, and then control passes back to step 104 to turn the fresh food compartment evaporator 40 on by appropriate operation of the various valves.

If, in step 106 it is determined that the fresh food compartment temperature sensor 46 is satisfied, then control passes to step 122 to initiate termination of the use of the fresh food compartment evaporator 40. Before the compressor is turned off, however, control passes to step 124 where it is inquired whether the freezer temperature sensor 47 is demanding cooling. If the freezer evaporator is demanding cooling, then control passes to step 126 to begin operation of the freezer evaporator 38.

If the freezer temperature sensor is not demanding cooling, then control passes to step 128 to determine whether the temperature within the freezer compartment 26 is within a certain range of the temperature at which the freezer temperature sensor will demand cooling (upper temperature limit), by checking the actual temperature indicated by the temperature sensor 47 in the freezer compartment. This temperature differential, designated $\Delta T_2$, is a temperature differential which can be related to a time period, given a standard rate of temperature increase for the freezer compartment. If this temperature differential is small enough, then this would signify that the freezer temperature sensor 47 will begin demanding cooling of the freezer compartment 26 within a very short period of time. Since initiation of the refrigeration cycle, that is the initial start up of the compressor 34, is the most inefficient portion of the refrigeration cycle, efficiencies in total energy consumption can be achieved by prematurely initiating the freezer cooling cycle by selecting an appropriate value for $\Delta T_2$. If the temperature differential is less than $\Delta T_2$, then control is passed to step 126 as described above. If the inquiry in step 128 determines that the temperature within the freezer is not within the small increment of the demand temperature, then control is passed to control unit 100 to restart the cycle from the off-cycle mode designated as ① on the flow diagram of FIG. 12.

If the response to the inquiry in step 100 is negative, control is passed to step 130 to determine whether the freezer temperature sensor 47 is demanding cooling. If it is not, control passes back to step 100 again to essentially wait in the off mode until one of the temperature sensors 46, 47 demands cooling.

If the freezer temperature sensor 47 demands cooling in step 130, then control is passed to step 126 where the freezer evaporator 38 is turned on by the control 48 by appropriate controlling of the valves and compressor 34. Control then passes to step 132 where inquiry is made to determine whether the freezer temperature sensor 47 is satisfied.

If the freezer temperature sensor 47 is not yet satisfied (if above the lower set limit), then control passes to step 134 to determine whether the fresh food compartment temperature sensor 46 is demanding cooling. If it is not, then control passes back to step 132 to repeat the loop. If the fresh food compartment temperature sensor is demanding cooling (if it is above the upper set limit), then control passes to step 136 to determine whether the freezer evaporator 38 has been operating longer than time period $T_{max2}$. If not, control passes back to step 132 to again repeat the loop.

Figure 12B:
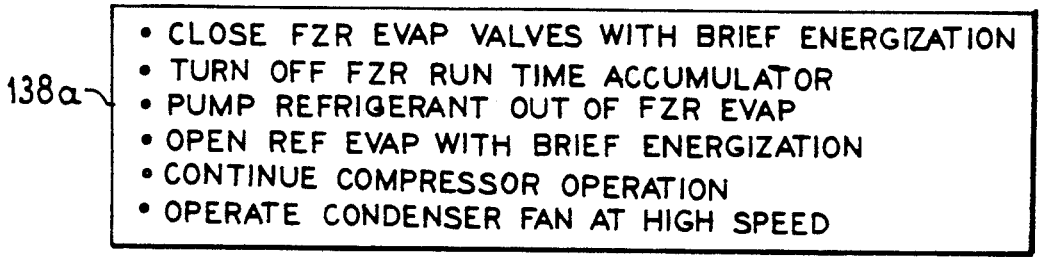
FIG. 12*b* illustrates an expansion of step 138 of FIG. 12.

If the freezer evaporator 38 runs longer than $T_{max2}$, then control passes to step 138, during which step the freezer evaporator 38 is turned off by appropriate control of the various valves, refrigerant is pumped out of the freezer evaporator and the fresh food compartment evaporator 40 is turned on through appropriate control of the valves (see FIG. 12*b*). Control then passes to step 140 to determine whether the fresh food compartment temperature sensor is satisfied.

If it is not yet satisfied (if above its lower set limit), control passes to control step 142 to determine whether the freezer temperature sensor 47 is demanding cooling. If it is, then control passes to control step 144 to determine whether the fresh food compartment evaporator 40 has been on for a time period greater than $T_{max1}$, the normal run time for the fresh food compartment evaporator. Once the fresh food compartment evaporator 40 has been running longer than time period $T_{max1}$, then control passes back to control step 126 to again initiate freezer cooling. This also occurs if the fresh food compartment temperature sensor 46 is deemed satisfied (lower limit temperature achieved) in step 140 prior to time period $T_{max1}$.

If the freezer temperature sensor 47, in step 132, is determined to be satisfied, then control passes to step 146 wherein the freezer evaporator 38 is turned off and refrigerant is pumped out of the freezer evaporator. Before the compressor 34 is turned off, control is passed to step 148 to determine whether the fresh food compartment temperature sensor 46 is demanding cooling. If it is (if above its above upper set limit), then control is passed to step 104 to repeat the above-described steps.

If the fresh food compartment temperature sensor is not yet demanding cooling, then control passes to step 150 to determine whether the fresh food compartment temperature is within a temperature differential designated $\Delta T_1$, of the temperature at which the fresh food compartment temperature sensor 46 (through controls 48) will initiate a demand for cooling, by checking the actual temperature indicated by the temperature sensor 46 in the fresh food compartment. As described above, if this temperature differential is of a predetermined small increment, then control will be passed to step 104 to initiate a premature cycle of operation of the fresh food compartment evaporator 40 to avoid a short "off" cycle and inefficient restarting of the compressor 34 shortly thereafter.

During the operation of the compressor 34 and condenser 36, various fans 42, 44 are operated by the control to cause air flow over one or both evaporators, as desired for cooling purposes and also a fan 152 is operated to cool the condenser. During the fresh food compartment cooling mode of operation, the amount of heat rejected by the condenser 36 increases substantially due to the higher suction pressure (thus higher cooling capacity operation). If nothing is done (that is, to effect the size of the condenser or the fan flow rate for the condenser), then the temperature difference between the condenser 36 and the sink temperature (ambient temperature) increases. This causes higher head pressures and lower compressor performance levels than otherwise possible. To reduce the temperature difference between the condenser and ambient temperature, the control may operate the condenser fan at different speeds. Thus, a higher speed and thus higher air flow fan operation for the condenser can be used 10 when the fresh food compartment evaporator is being operated (see FIGS. 12*a* and 12).

Another improvement in efficiency of the system relates to the defrost cycle. In present, commercially available refrigerators, the evaporator which provides cooling below 0 centigrade goes through a defrost period cycle usually based upon compressor run time. Usually when the preselected amount of time for the running of the compressor has occurred, the compressor is taken off-line through a cam switch and a defrost heater 154 is energized. Thus, any cooling done in the freezer compartment is stopped and must then be overcome by the defrost heater.

An improved cycle is illustrated schematically in FIG. 13. In that graph, there is a curve 200 shown schematically as a linear saw tooth curve, although in reality the segments of that curve would most likely not be linear. The curve 200 represents the increase and decrease of temperature within the freezer compartment over time. The positively sloped segments represent times when the evaporator 38 is not being cooled and the negatively sloped portions of the curve represent those times when the evaporator is providing cooling. A first point in time is designated by vertical line 202 which represents the initiation of a cooling cycle, that is the initiation of cooling by the freezer evaporator 38. A subsequent vertical line 204 represents a subsequent initiation of the cooling cycle by the evaporator.

Figure 12C:
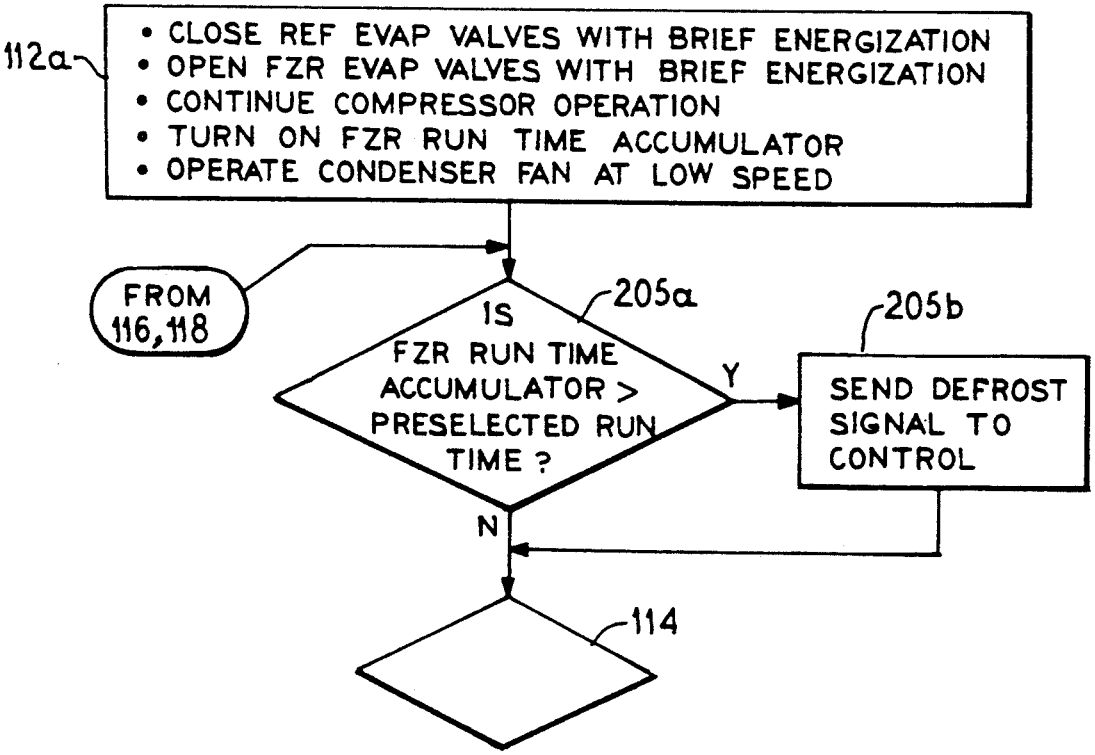
FIG. 12*c* illustrates an expansion of step 112 of FIG. 12 and an addition of steps between steps 112 and 114.
Figure 12D:
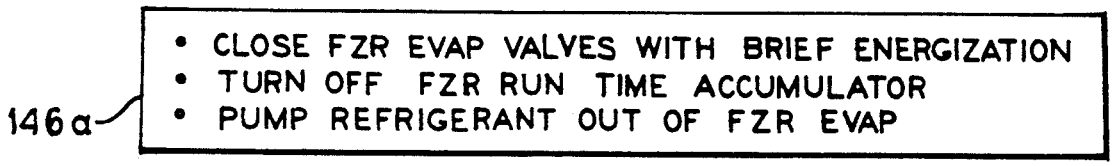
FIG. 12*d* illustrates an expansion of step 146 of FIG. 12.
Figure 12E:
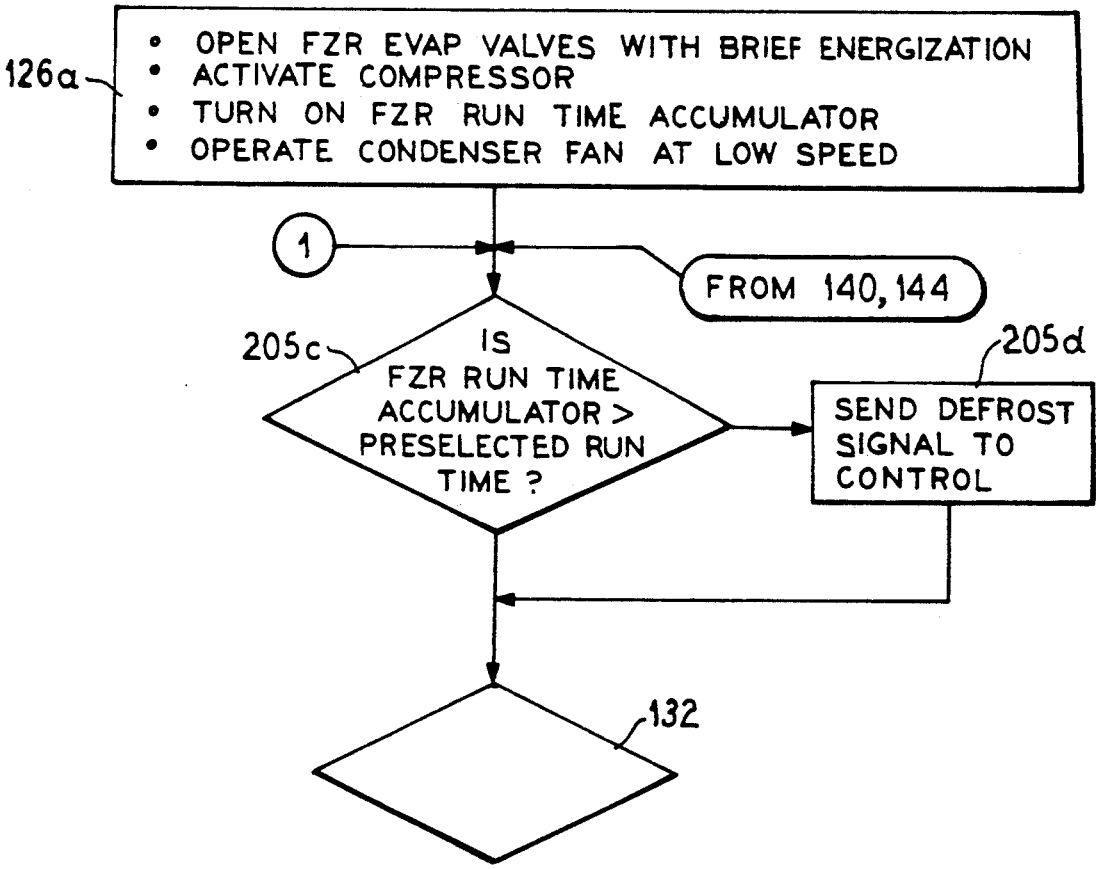
FIG. 12*e* illustrates an expansion of step 126 and an addition of steps between steps 126 and 132 of FIG. 12.
Figure 12F:
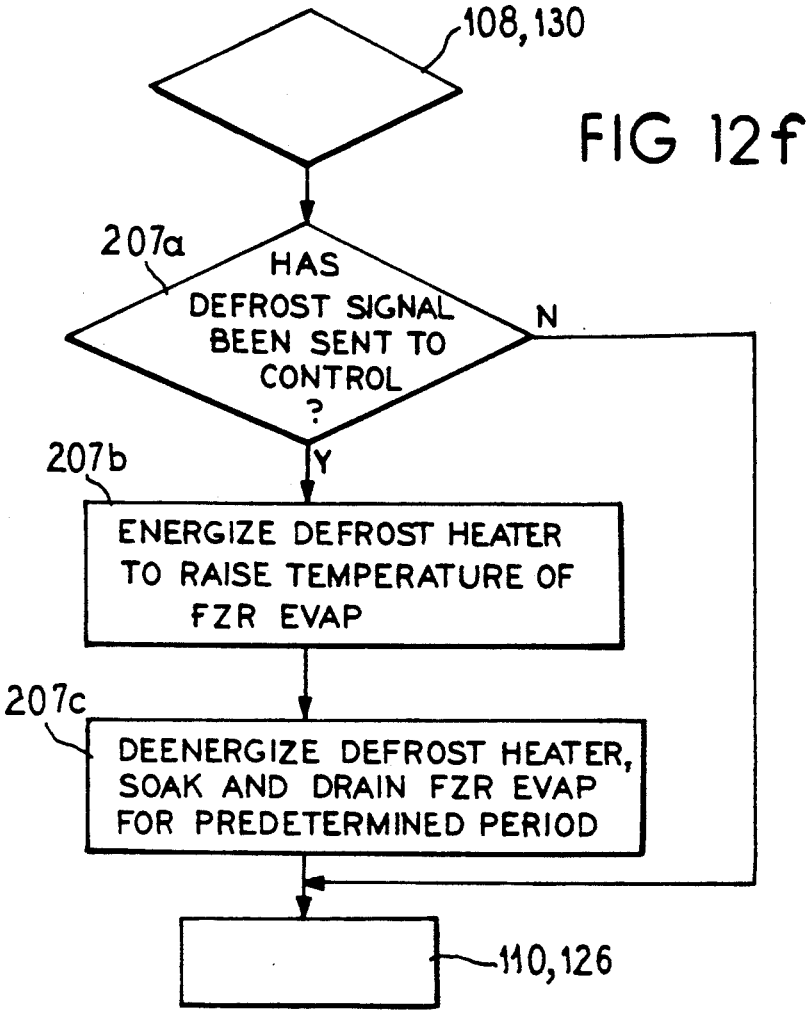
FIG. 12*f* illustrates an embodiment of the method with additional steps between steps 108 and 110 or steps 130 and 126 of FIG. 12.

In this improved cycle, a signal is generated by the control 48 after a preselected number of hours of freezer mode run time (see steps 205*a*, 205*b* in FIG. 12*c* and steps 205*c* and 205*d* in FIG. 12*e*). Vertical line 206 represents the point in time such a signal is generated. However, the defrost heater is not energized by the control upon the generation of signal at time 206. The defrost heater is energized only after any then ongoing cooling cycle is terminated and the freezer compartment temperature has risen to the high limit set point used during normal cycle operation (this might occur at steps 207*a*, 207*b* and 207*c* shown in FIG. 12*f*). That is, in the illustration of FIG. 13, the defrost heater will not be energized until time represented at line 204. This 15 reduces the amount of defrost heater on time required to bring the evaporator plenum temperature up to the frost melt point and it eliminates freezer mode cooling just prior to defrost. Thus, the maximum effect of any ongoing cooling cycle will be taken advantage of.

In some cycle operations, the operation of the fresh food compartment evaporator 40 may occur independently of the freezer defrost control as may occur between steps 108 and 110 and steps 130 and 126 as shown in FIG. 12. Thus, during the freezer defrost period, the fresh food circuit can be run to cool that respective compartment. However, since commercial embodiments of the compressor 34 and defrost heaters require a current draw which may exceed standard 15 ampere fuses/circuit breakers used in the United States, a second cycle step may be used.

Figure 12G:
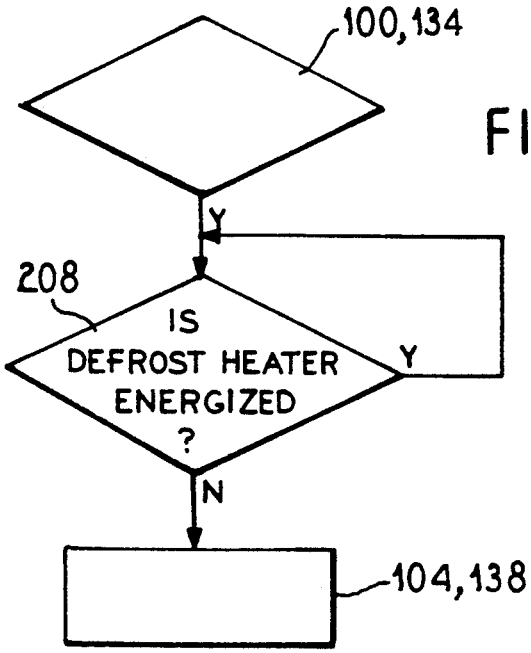
FIG. 12*g* illustrates an embodiment of the invention with an additional step between steps 100 and 104 and 134 and 138 of FIG. 12.

The second cycle step does not allow fresh food cooling while the defrost heater is being energized see step 208 in FIG. 12*g*. However, following the energization of the defrost heater there is a soak and drain portion of the defrost cycle (see 207*c* in FIG. 12*f*) which does not require a significant current drain. Thus, the fresh food circuit may operate during the soak and drain portion of the defrost (see FIG. 12*g*). By allowing this semi-independent fresh food control, the fresh food compartment can be cooled even while the freezer circuit is off-line.

After the defrost period is over, the freezer temperature sensor 47 will call for a cooling and the cooling system should then be ready to dedicate operation of the freezer evaporator 38 to defrost recovery, in accordance with the steps outlined with respect to those described in FIG. 12.

Another improvement to the efficiency of the system is to use latching-type on/off solenoid valves. As was described above, during the "off" cycle, the fresh food circuit through lines 56 and 68 was left open to equalize the pressure across compressor 34 to assist in the start-up of the compressor. This permitted migration of refrigerant through the fresh food compartment evaporator 40 and thus provides a potential for thermal input into the fresh food compartment 30 during the entire time that the refrigeration apparatus is "off". Since it only requires three to four minutes for the pressures to equalize across the compressor 34 when the fresh food circuit is opened, an enhancement to the cycle is to use latching solenoid valves that do not use electrical power to remain closed, or open, but yet require only minimal energy to switch the valves between an off and on position. Thus, the freezer circuit and fresh food circuit can remain "closed" during the majority of the time that the refrigeration mechanism is in an "off" mode, and then three to four minutes prior to initiation of the compressor, the valve closing the fresh food circuit can be briefly energized to move it to an open position thereby allowing equalization of the pressure across the compressor prior to its start up.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A method of operating a refrigeration appliance having at least two separate compartments to be cooled and a refrigeration device with two separate evaporators, one for each of said compartments, comprising:

1) detecting whether said either of said compartments is demanding cooling;
2) upon detection of a cooling demand by a first compartment, operating said first compartment evaporator until the detected demand for cooling has been satisfied, then returning to step 1);
3) detecting whether said second compartment is demanding cooling during cooling of said first compartment;
4) upon demand by said second compartment for cooling prior to satisfaction of the demand by said first compartment, continuing the cooling of said first compartment until obtaining the first to occur of satisfying said demand for cooling by said first compartment or passage of a first preset time period;
5) upon obtaining said first to occur, terminating operation of said first compartment evaporator and initiating operation of said second compartment evaporator until the detected demand for cooling of said second compartment has been satisfied, then returning to step 1);
6) detecting whether said first compartment is demanding cooling during cooling of said second compartment;
7) upon demand by said first compartment, continuing the cooling of said second compartment until obtaining the first to occur of satisfying said demand for cooling by said second compartment or passage of a second preset time period;
8) upon obtaining said first to occur, terminating operation of said second compartment evaporator and initiating operation of said first compartment evaporator until the detected demand for cooling of said first compartment has been satisfied, then returning to step 1); and
9) returning to step 3).

2. A method according to claim 1 and further including the step of operating one of said evaporators at a lower pressure than the other to produce a cooler temperature in one of the compartments than the other.

3. A method according to claim 2 including the step of evacuating refrigerant from said evaporator operated at a lower pressure prior to initiating operation of said evaporator operated at a higher pressure.

4. A method according to claim 1 wherein said first preset time period comprises a preset normal run time for said first compartment evaporator.

5. A method according to claim 1 wherein said second preset time period comprises a preset normal run time for said second compartment evaporator.

6. A method according to claim 1 including, prior to terminating operation of one of said evaporators, the steps of detecting a temperature in the other of said compartments, comparing it to a demand temperature at which said other compartment will begin demanding cooling, and if said detected temperature is sufficiently close to said demand temperature, prematurely initiating operation of said other compartment's evaporator immediately upon termination of operation of said one evaporator.

7. A method according to claim 2 wherein said refrigeration device includes a condenser cooled by a fan and further including the step of operating said fan at a higher speed when operating said higher pressure evaporator.

8. A method according to claim 1 including the step of periodically raising the temperature of at least one of said evaporators to effect a defrosting of water vapor condensed and frozen on said evaporator.

9. A method according to claim 8 wherein said step of raising the temperature occurs the first time after some predetermined time period when a compartment associated with said evaporator next demands cooling.

10. A method according to claim 8 wherein a step of operation of an evaporator not being defrosted is independent of whether the other evaporator is being defrosted.

11. A method according to claim 8 wherein said step of raising the temperature of an evaporator to effect a defrosting thereof is followed by a period of soaking and draining of that evaporator, and operation of the other of said evaporators is suspended only when said first evaporator is having its temperature elevated, not when it is soaking or draining.

12. A method according to claim 1 wherein said initiating and terminating operation of said evaporators is achieved in part by selectively opening and closing valves in a refrigeration circuit.

13. A method according to claim 12 wherein said step of opening and closing valves comprises briefly energizing said valves to cause them to cycle between an open and closed position where they will remain until they are again briefly energized.

14. A refrigeration appliance having at least a first and a second separate compartment to be cooled and a refrigeration device with two separate evaporators, one for each of said compartments, comprising:

means for detecting whether said either of said compartments is demanding cooling;

means for operating a first compartment evaporator until the detected demand for cooling has been satisfied, upon detection of a cooling demand by said first compartment;

means for detecting whether said second compartment is demanding cooling during cooling of said first compartment;

means for continuing the cooling of said first compartment until obtaining a first to occur of satisfying said demand for cooling by said first compartment or passage of a first preset time period, upon detecting demand by said second compartment for cooling prior to satisfaction of the demand by said first compartment;

means for terminating operation of said first compartment evaporator and initiating operation of said second compartment evaporator until the detected demand for cooling of said second compartment has been satisfied, upon obtaining said first to occur;

means for detecting whether said first compartment is demanding cooling during cooling of said second compartment;

means for continuing the cooling of said second compartment until obtaining a first to occur of satisfying said demand for cooling by said second compartment or passage of a second preset time period, upon demand by said first compartment; and means for terminating operation of said second compartment evaporator and initiating operation of said first compartment evaporator until the detected demand for cooling of said first compartment has been satisfied, upon obtaining said first to occur.

15. A refrigeration appliance according to claim 14 and further including means for operating one of said evaporators at a lower pressure than the other to produce a cooler temperature in one of the compartments than the other.

16. A refrigeration appliance according to claim 15 wherein said refrigeration device includes a condenser cooled by a fan and further including means for operating said fan at a higher speed when operating said higher pressure evaporator.

17. A refrigeration appliance according to claim 14 including means for periodically raising the temperature of at least one of said evaporators to effect a defrosting of water vapor condensed and frozen on said evaporator.

18. A refrigeration appliance according to claim 14, wherein said refrigeration device includes conduits for carrying a fluid refrigerant and valves positioned in said conduits which may be selectively opened and closed to initiate and terminate operation of said evaporators.

19. A method of operating a refrigeration appliance having at least two separate compartments to be cooled and a refrigeration device with two separate evaporators, one for each of said compartments, comprising:

1) upon detection of a cooling demand by a first compartment, operating said first compartment evaporator until the detected demand for cooling has been satisfied, or if a demand by said second compartment is detected prior to satisfying the demand of said first compartment, continuing the cooling of said first compartment until obtaining a first to occur of satisfying said demand for cooling by said first compartment or passage of a first preset time period;

2) upon obtaining said first to occur, terminating operation of said first compartment evaporator and initiating operation of said second compartment evaporator until the detected demand for cooling of said second compartment has been satisfied, or if a demand by said first compartment is detected prior to satisfying the demand of said second compartment, continuing the cooling of said second compartment until obtaining a subsequent first to occur of satisfying said demand for cooling by said second compartment or passage of a second preset time period;

3) upon obtaining said subsequent first to occur, terminating operation of said second compartment evaporator and returning to step 1).

* * * * *